US007828464B2

(12) United States Patent
Wang et al.

(10) Patent No.: US 7,828,464 B2
(45) Date of Patent: Nov. 9, 2010

(54) LED LAMP STRUCTURE AND SYSTEM WITH HIGH-EFFICIENCY HEAT-DISSIPATING FUNCTION

(75) Inventors: Bily Wang, Hsinchu (TW); Jonnie Chuang, Banciao (TW); Shih-Yu Wu, Banciao (TW)

(73) Assignee: Harvatek Corporation, Hsinchu (TW)

( * ) Notice: Subject to any disclaimer, the term of this patent is extended or adjusted under 35 U.S.C. 154(b) by 301 days.

(21) Appl. No.: 11/984,447

(22) Filed: Nov. 19, 2007

(65) Prior Publication Data

US 2009/0009999 A1 Jan. 8, 2009

(30) Foreign Application Priority Data

Jul. 6, 2007 (TW) ..... 96124784 A

(51) Int. Cl.
*F21V 29/00* (2006.01)

(52) U.S. Cl. ..... 362/294; 362/247; 362/373; 257/98; 257/99

(58) Field of Classification Search ..... 362/247, 362/294, 373; 257/98, 99, 675, 676, 706, 257/712, 722
See application file for complete search history.

(56) References Cited

U.S. PATENT DOCUMENTS 6,782,941 B2 * 8/2004 Lee ..... 165/80.3
2006/0250800 A1 * 11/2006 Chang et al. ..... 362/294

* cited by examiner

*Primary Examiner*—Ismael Negron
(74) *Attorney, Agent, or Firm*—Rosenberg, Klein & Lee

(57) ABSTRACT

An LED lamp structure with high-efficiency heat-dissipating function includes a heat-dissipating module, a light-emitting module, a power-transmitting module, and a casing module. The heat-dissipating module has a plurality of heat-dissipating fins, and the heat-dissipating fins are combined together to form a radial shape and a receiving space. The light-emitting module is received in the receiving space of the heat-dissipating module. The power-transmitting module is electrically connected with the light-emitting module. The casing module has a top board body, a bottom board body mated with the top board body, and a joint board body disposed between the top board body and the heat-dissipating fins. Both the top board body and the joint board body have an opening for exposing the light-emitting module. Each heat-dissipating fin has a top side contacted with the joint board body and a bottom side separated from the bottom board body by a predetermined distance.

26 Claims, 14 Drawing Sheets

LED LAMP STRUCTURE AND SYSTEM WITH HIGH-EFFICIENCY HEAT-DISSIPATING FUNCTION

BACKGROUND OF THE INVENTION

1. Field of the Invention

The present invention relates to an LED lamp structure and system, and particularly relates to an LED lamp structure and system with high-efficiency heat-dissipating function.

2. Description of the Related Art

LED (Light-Emitting Diode) has some advantages better than traditional light source, such as small size, save power, good light-emitting efficiency, long usage life, high-speed operation response, no poison pollution as radiation and mercury. In recent years, LED has been used popularly. Hence, the tradition light-emitting device is replaced by LED with high brightness such as high power LED due to the progress of high technology.

However, the heat-dissipating efficiency of the LED is bad. A heat-guiding element or a heat-dissipating element needs to assist the LED to guide or dissipate heat out in order to operate the LED in a low temperature. Hence it is very important job for designers to deign an LED lamp device with high-efficiency heat-dissipating function

SUMMARY OF THE INVENTION

One particular aspect of the present invention is to provide an LED lamp structure and system with high-efficiency heat-dissipating function. The present invention use a heat-dissipating module with radial-shape fins for supplying high-efficiency heat-dissipating function to high power LED. Hence LEDs of the present invention are used in a low temperature to ensure that the usage life of the LEDs is increased.

In order to achieve the above-mentioned aspects, the present invention provides an LED lamp structure with high-efficiency heat-dissipating function, including: a heat-dissipating module, a light-emitting module, and a power-transmitting module.

The heat-dissipating module has a plurality of heat-dissipating fins, and the heat-dissipating fins are combined together to form a radial shape and a receiving space. The light-emitting module is received in the receiving space of the heat-dissipating module. The power-transmitting module is electrically connected with the light-emitting module. Moreover, the light-emitting module includes a substrate with a positive conductive track and a negative conductive track, two inner conductive pins, at least one light-emitting element electrically connected with the positive conductive track and the negative conductive track via the two inner conductive pins, a fluorescent colloid covered on the at least one light-emitting element, and a light-shielding frame body for covering a peripheral face of the fluorescent colloid and only exposing a top surface of the fluorescent colloid.

Furthermore, the LED lamp structure further includes a casing module. The casing module has a top board body, a bottom board body mated with the top board body, and a joint board body disposed between the top board body and the heat-dissipating fins. Both the top board body and the joint board body have an opening for exposing the light-emitting module. Alternatively, each heat-dissipating fin has a top side and a bottom side respectively contacted with the joint board body and the bottom board body, or each heat-dissipating fin has a top side contacted with the joint board body and a bottom side separated from the bottom board body by a predetermined distance.

In order to achieve the above-mentioned aspects, the present invention provides an LED lamp system with high-efficiency heat-dissipating function, including a plurality of LED lamp structures and a power supply plug.

Each LED lamp structure includes a heat-dissipating module, a light-emitting module, and a power-transmitting module. The heat-dissipating module has a plurality of heat-dissipating fins, and the heat-dissipating fins are combined together to form a radial shape and a receiving space. The light-emitting module is received in the receiving space of the heat-dissipating module. The power-transmitting module is electrically connected with the light-emitting module. The power supply plug is electrically connected with the power-transmitting module of each LED lamp structure.

According to different heat-dissipating needs, the heat-dissipating fins of each heat-dissipating module have different embodiment aspects, as follows:

1. Each heat-dissipating fin of each heat-dissipating module has a stacked portion and a fined portion extended forward and upward from a lateral side of the stacked portion. Each light-emitting module is correspondingly disposed on the stacked portions of the heat-dissipating fins of each heat-dissipating module.

2. Each heat-dissipating fin of each heat-dissipating module has a stacked portion and a fined portion extended forward and upward from a lateral side of the stacked portion. In addition, each LED lamp structure further includes a heat-dissipating substrate received in the corresponding receiving space and disposed on top surfaces of the corresponding stacked portions. The heat-dissipating substrate has a peripheral face abutting against inner lateral sides of the corresponding fined portions. The light-emitting modules are respectively disposed on the corresponding heat-dissipating substrates.

3. Each heat-dissipating fin of each heat-dissipating module has a stacked portion and a fined portion extended forward, upward and downward from a lateral side of the stacked portion. In addition, each LED lamp structure further includes a heat-dissipating substrate abutting against bottom surfaces of the corresponding stacked portions and inner lateral sides of the corresponding fined portions. Each light-emitting module is disposed on the stacked portions of each corresponding heat-dissipating module.

4. Each heat-dissipating fin of each heat-dissipating module has a fixed portion and a fined portion extended upward from the fixed portion. In addition, each LED lamp structure further includes a heat-dissipating substrate abutting against inner lateral sides of the fixed portions of each corresponding heat-dissipating module. The light-emitting modules are respectively disposed on the corresponding heat-dissipating substrates.

5. Each heat-dissipating fin of each heat-dissipating module has an embedded portion and a fined portion extended forward, upward and downward from a lateral side of the embedded portion. In addition, each LED lamp structure further includes a heat-dissipating substrate. The heat-dissipating substrate has a plurality of concave grooves formed on a peripheral face thereof and corresponding to the embedded portions, and each embedded portion of each heat-dissipating fin is embedded into the concave groove in order to make the peripheral face of the heat-dissipating substrate abut against inner lateral sides of the fined portions. The light-emitting modules are disposed on the corresponding heat-dissipating substrates, respectively.

Hence, the LED lamp structure and system can provides high-efficiency heat-dissipating function for increasing the usage life of LEDs of the present invention, high power LED especially.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objects and advantages of the present invention will be more readily understood from the following detailed description when read in conjunction with the appended drawings, in which.

DETAILED DESCRIPTION OF THE PREFERRED EMBODIMENTS

Figure 1A:
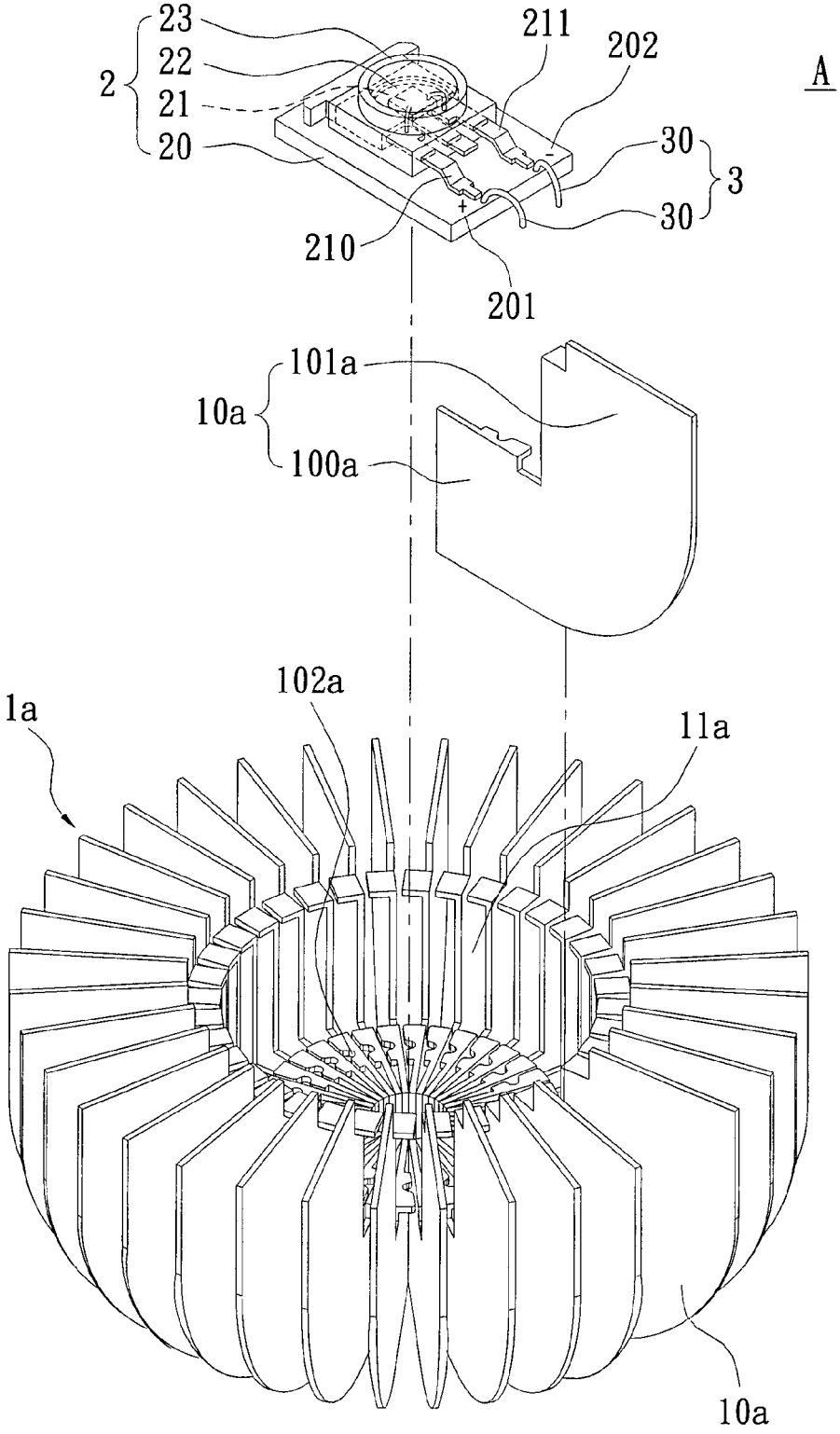
FIG. 1A is a partial, perspective, exploded view of an LED lamp structure with high-efficiency heat-dissipating function according to the first embodiment of the present invention.
Figure 1B:
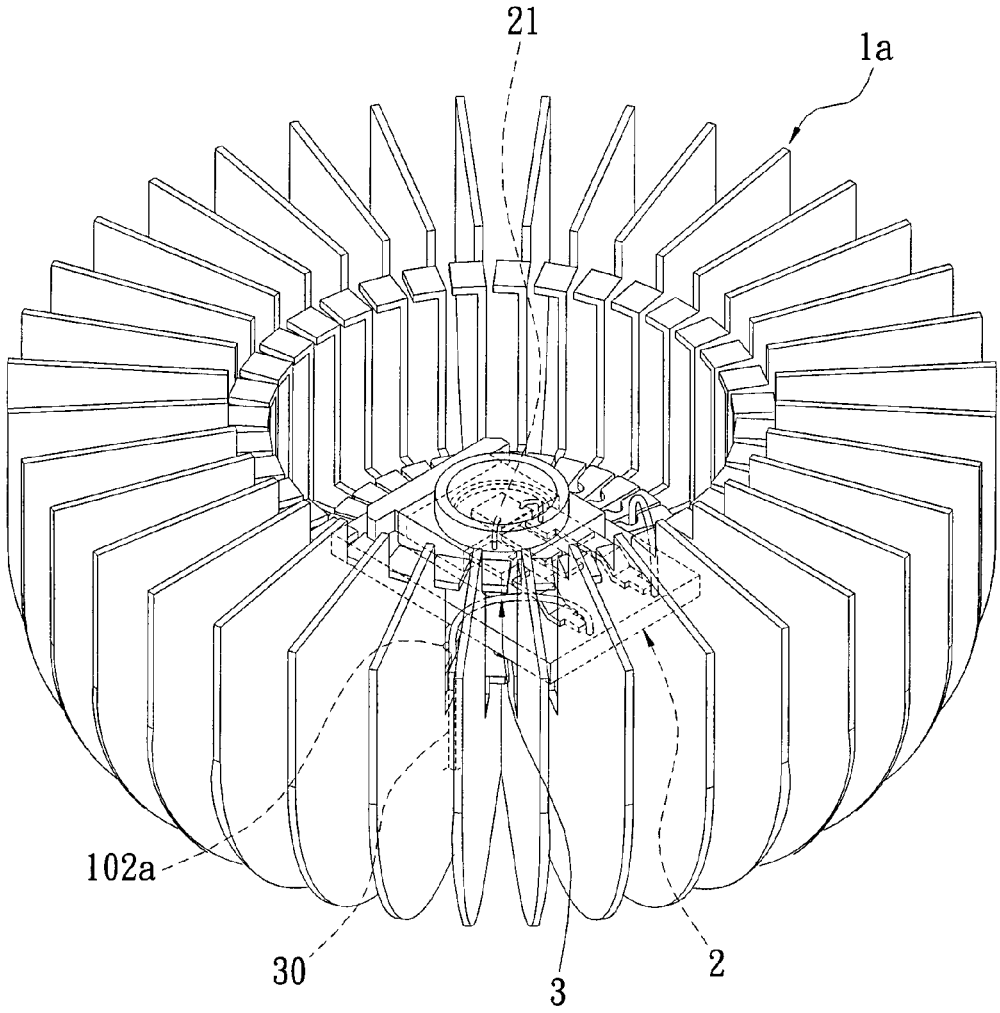
FIG. 1B is a perspective, assembled view of an LED lamp structure with high-efficiency heat-dissipating function according to the first embodiment of the present invention.
Figure 1C:
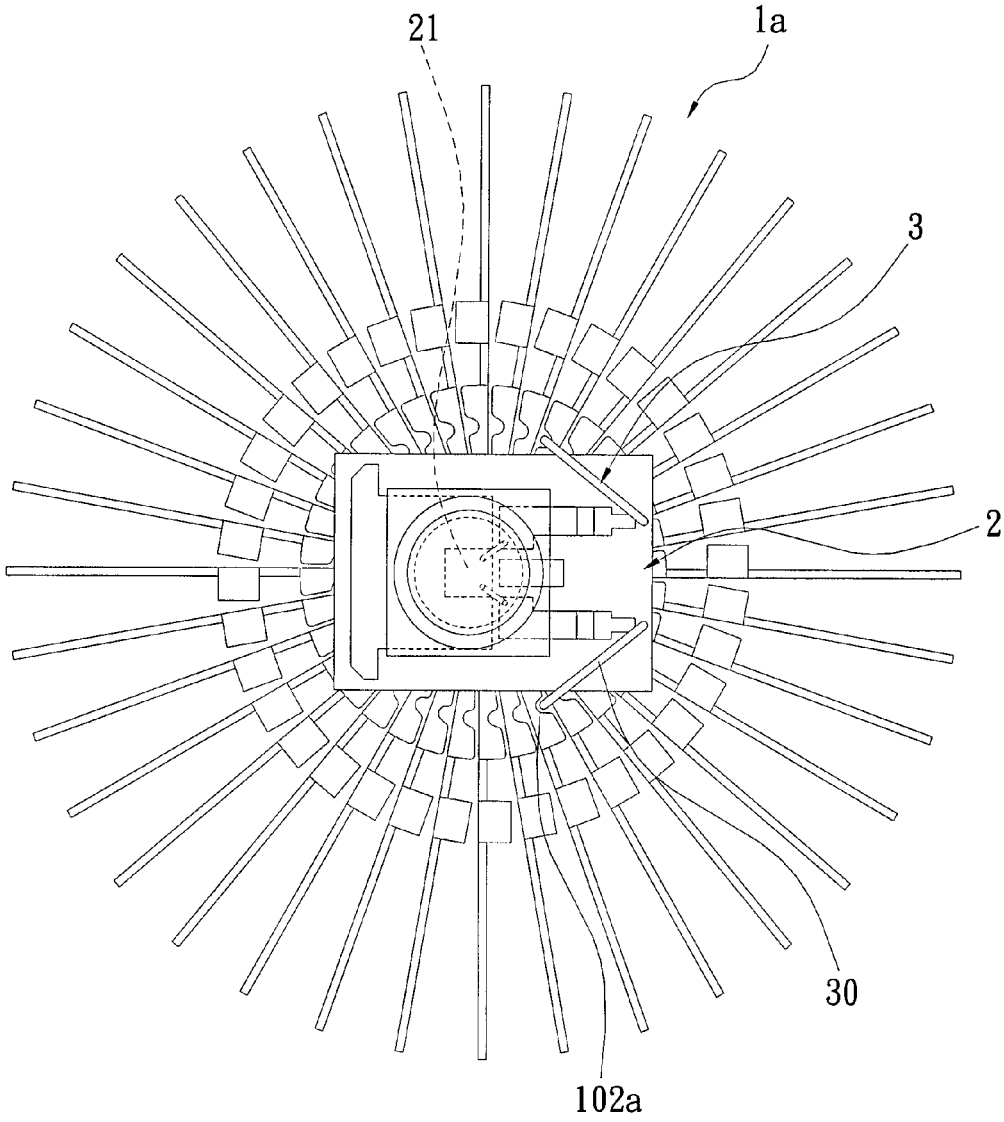
FIG. 1C is a top view of an LED lamp structure with high-efficiency heat-dissipating function according to the first embodiment of the present invention.
Figure 1D:
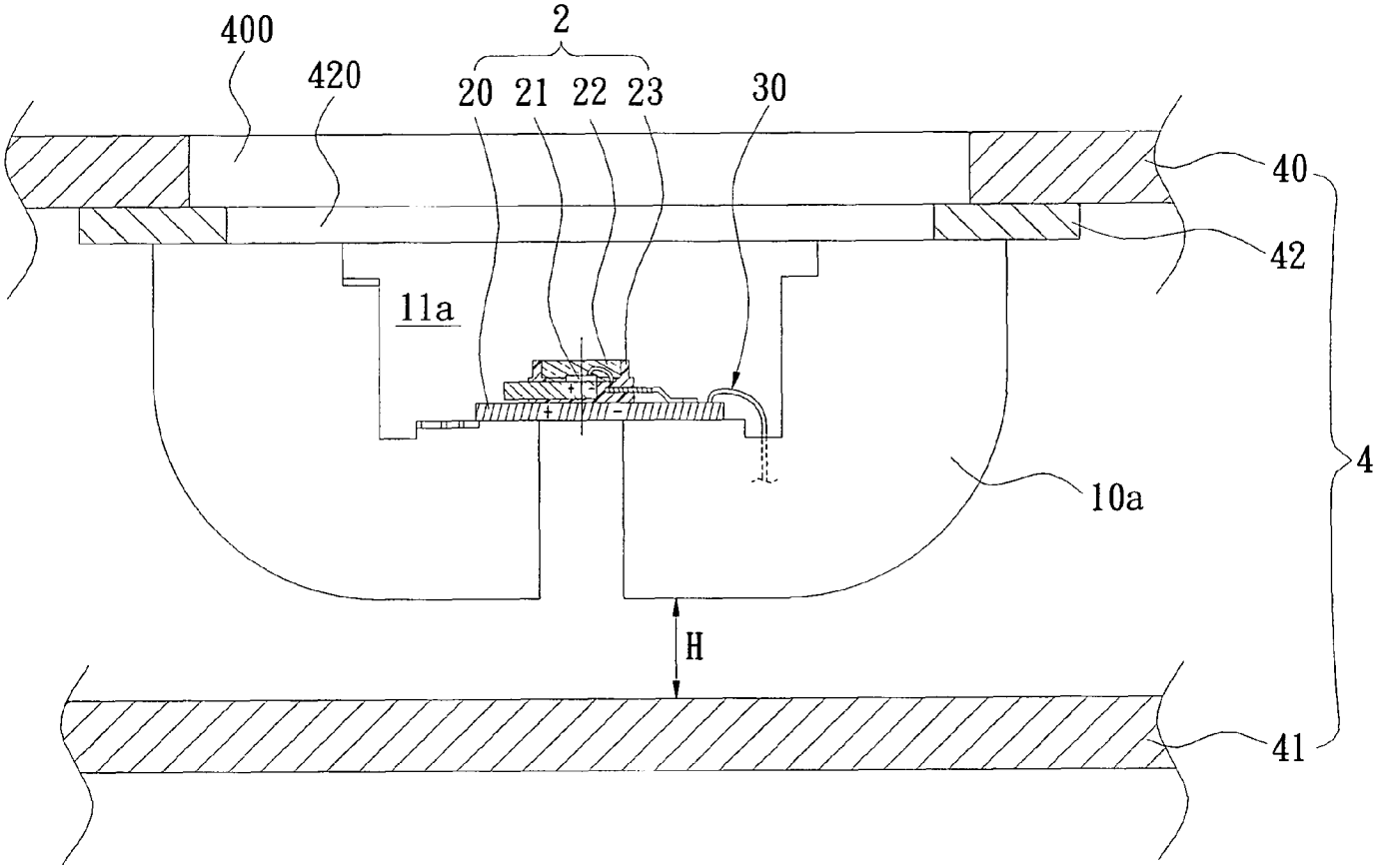
FIG. 1D is a lateral, cross-sectional view of an LED lamp structure having a top board body, a bottom board body, a joint board body, and a plurality of heat-dissipating fins separated from the bottom board body according to the first embodiment of the present invention.

FIGS. 1A to 1D show a partial, perspective, exploded view, a perspective, assembled view, a top view, and a lateral, cross-sectional view of an LED lamp structure with high-efficiency heat-dissipating function according to the first embodiment of the present invention, respectively. The first embodiment of the present invention provides an LED lamp structure A with high-efficiency heat-dissipating function, including a heat-dissipating module 1*a*, a light-emitting module 2, and a power-transmitting module 3.

The heat-dissipating module 1*a* has a plurality of heat-dissipating fins 10*a*. The heat-dissipating fins 10*a* are combined together to form a radial shape and a receiving space 11*a* formed at a central position of the heat-dissipating module 1*a*. Hence, the heat-dissipating module 1*a* is a heat-dissipating module with radial fins.

Moreover, each heat-dissipating fin 10*a* has a stacked portion 100*a* and a fined portion 101*a* extended forward and upward from a lateral side of the stacked portion 100*a*. The heat-dissipating module 1*a* has a plurality of through holes 102*a* formed between each two stacked portions 100*a*. In addition, the stacked portions 100*a* are stacked with each other to make the heat-dissipating fins 10*a* stacked with each other and combined together.

In the first embodiment, the stacked portions 100*a* are left and right stacked with each other to make the heat-dissipating fins 10*a* stacked with each other and combined together. According to different needs, the stacked portions 100*a* can be up and down stacked with each other to make the heat-dissipating fins 10*a* stacked with each other and combined together.

Furthermore, the light-emitting module 2 is received in the receiving space 11*a* of the heat-dissipating module 1*a* and is disposed on the stacked portions 100*a*. The light-emitting module 2 includes a substrate 20 with a positive conductive track 201 and a negative conductive track 202, two inner conductive pins (210, 211), at least one light-emitting element 21 electrically connected with the positive conductive track 201 and the negative conductive track 202 via the two inner conductive pins (210, 211), a fluorescent colloid 22 covered on the at least one light-emitting element 21, and a light-shielding frame body 23 for covering a peripheral face of the fluorescent colloid 22 and only exposing a top surface of the fluorescent colloid 22.

In addition, the power-transmitting module 3 is electrically connected with the light-emitting module 2. The power-transmitting module 3 has two leading wires 30 electrically connected with the positive conductive track 201 and the negative conductive track 202 of the substrate 20, respectively.

Referring to FIG. 1D again, the present invention of the first embodiment further includes a casing module 4. The casing module 4 has a top board body 40, a bottom board body 41 mated with the top board body 40, and a joint board body 42 disposed between the top board body 40 and the heat-dissipating fins 10*a*. The top board body 40 has an opening 400 for exposing the light-emitting module 2. The joint board body 42 has an opening 420 for exposing the light-emitting module 2. The top board body 40 and the bottom board body 41 are assembled and screwed together via many screws (not shown). In other words, each heat-dissipating fin 10*a* has a top side contacted with the joint board body 42 and a bottom side separated from the bottom board body 41 by a predetermined distance H. Hence, the heat-dissipating fins 10*a* can be fixed under the top board body 40 easily by using the joint board body 42.

Figure 1E:
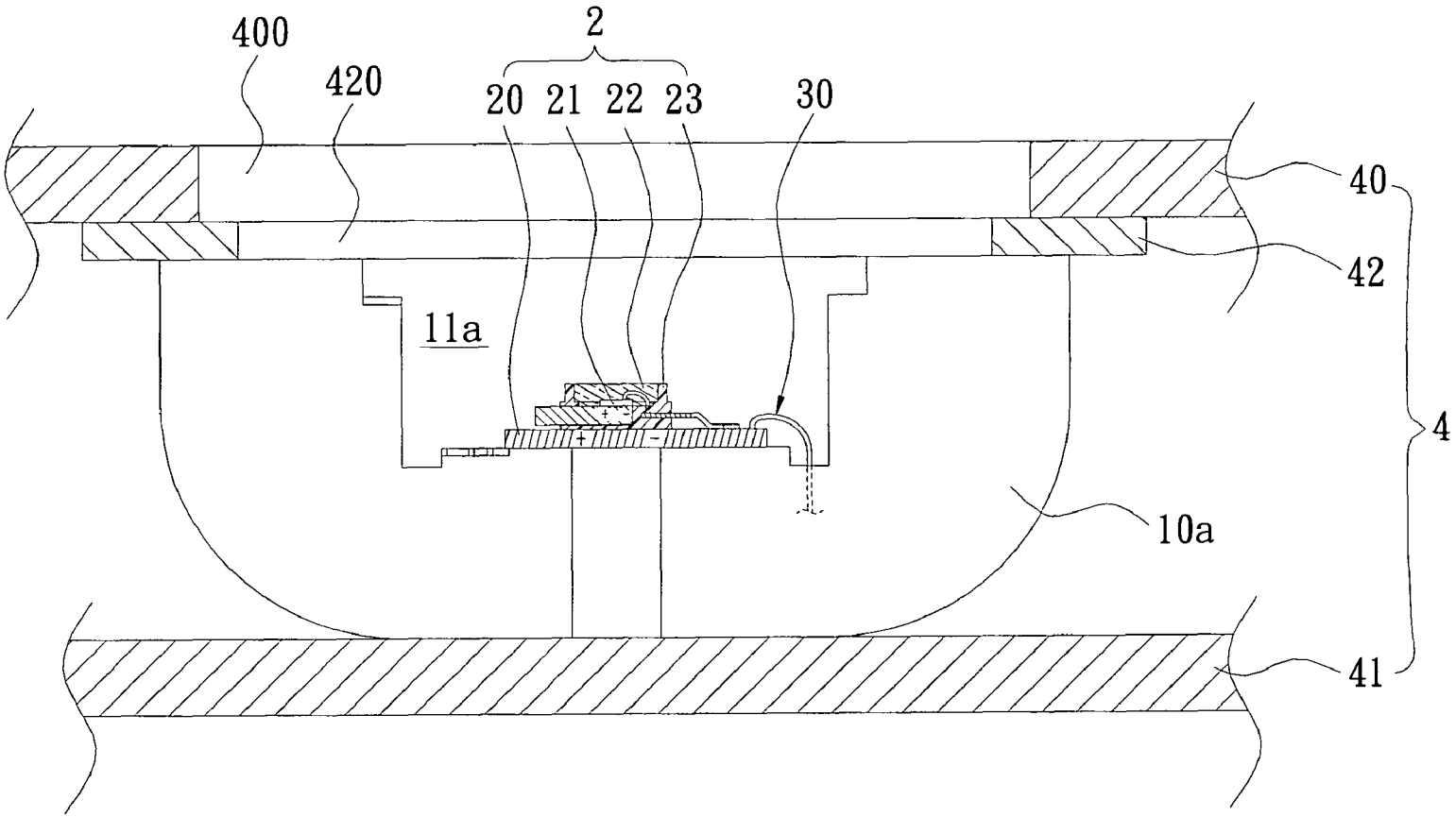
FIG. 1E is a lateral, cross-sectional view of an LED lamp structure having a top board body, a bottom board body, a joint board body, and a plurality of heat-dissipating fins contacted with the bottom board body according to the first embodiment of the present invention.

FIG. 1E shows a lateral, cross-sectional view of an LED lamp structure having a top board body, a bottom board body, a joint board body, and a plurality of heat-dissipating fins contacted with the bottom board body according to the first embodiment of the present invention. According to different heat-dissipating needs, each heat-dissipating fin 10*a* has a top side and a bottom side respectively contacted with the joint board body 42 and the bottom board body 41.

Figure 2A:
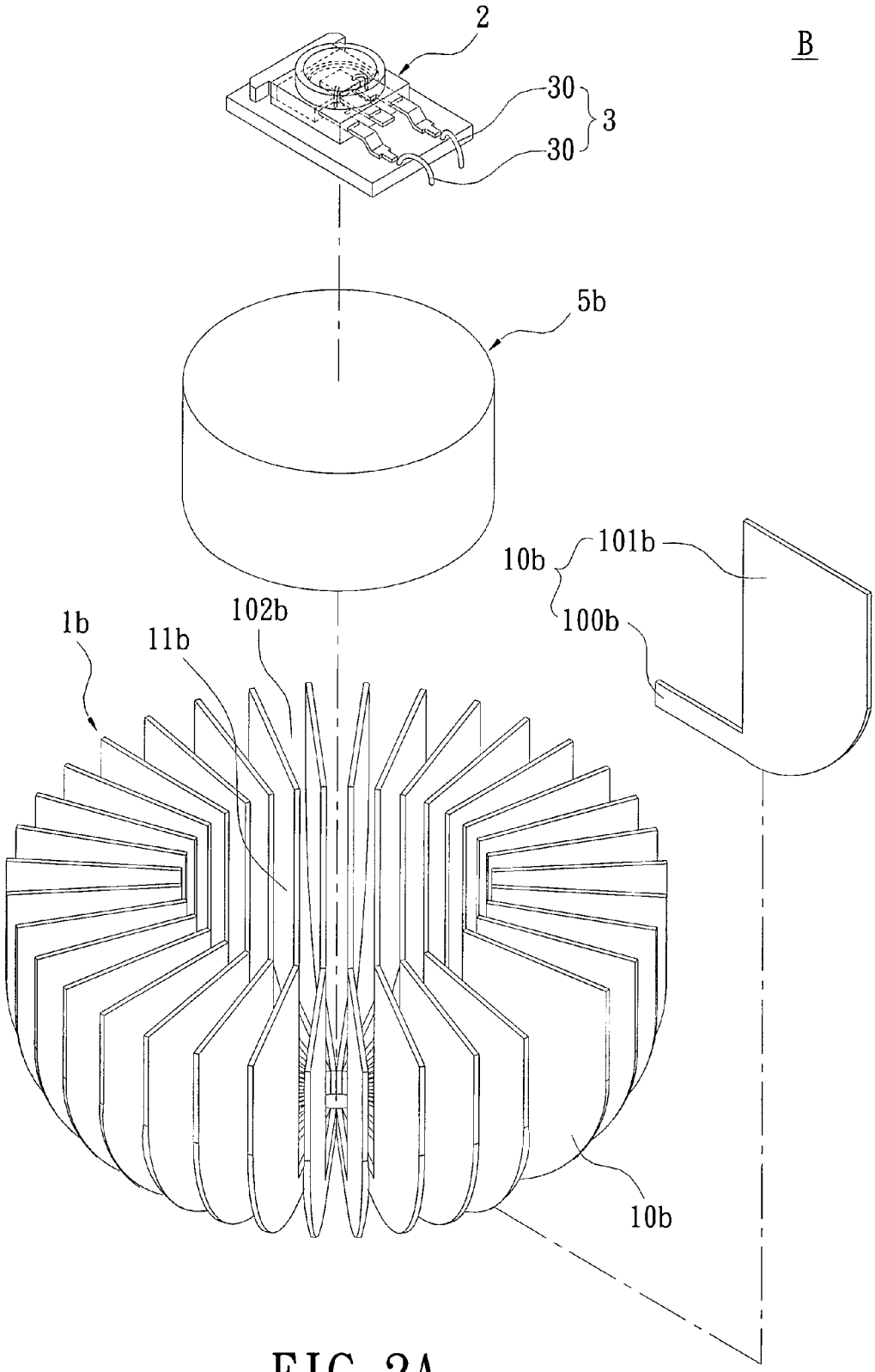
FIG. 2A is a partial, perspective, exploded view of an LED lamp structure with high-efficiency heat-dissipating function according to the second embodiment of the present invention.
Figure 2B:
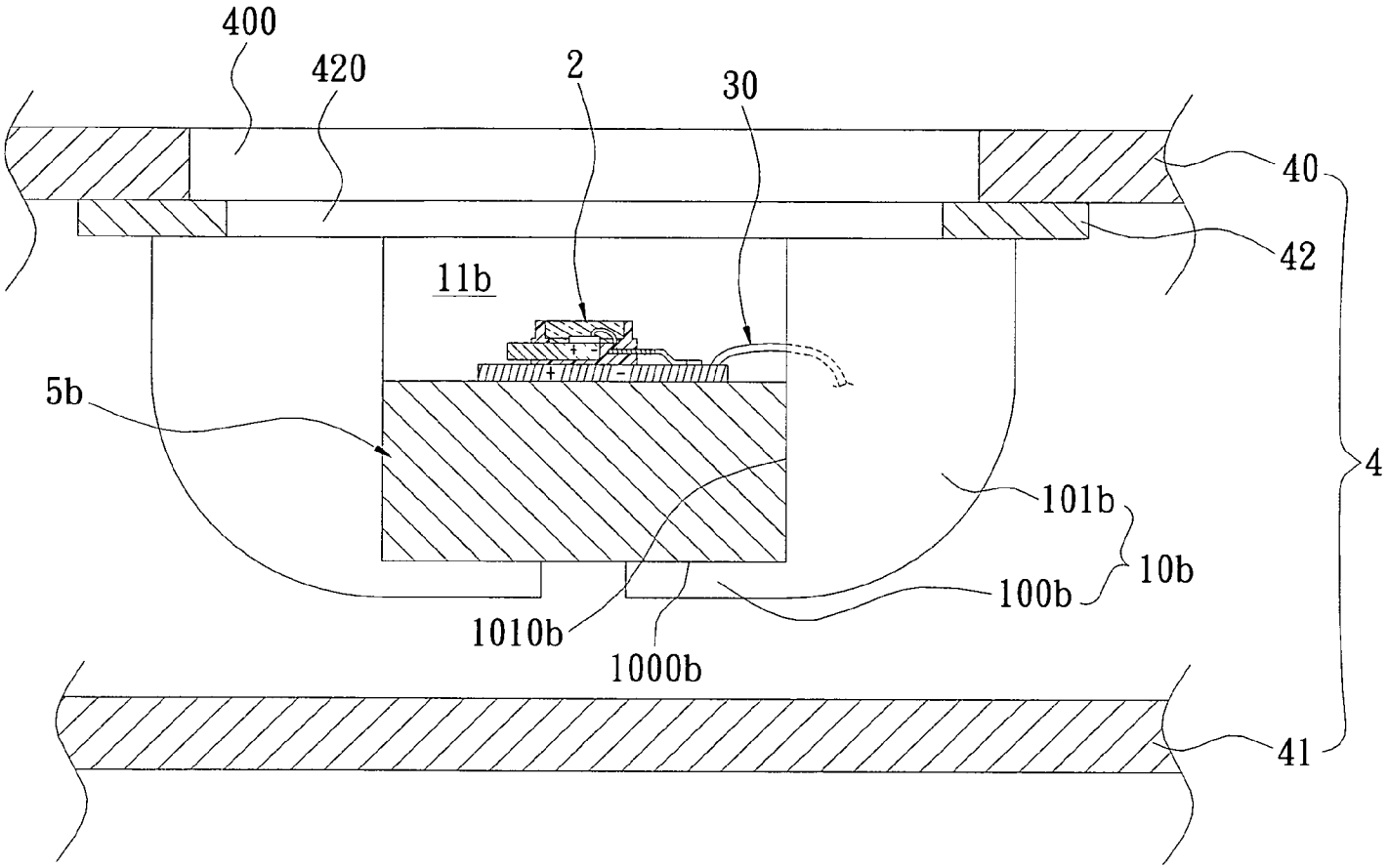
FIG. 2B is a lateral, cross-sectional view of an LED lamp structure having a top board body, a bottom board body, and a joint board body according to the second embodiment of the present invention.

Referring to FIGS. 2A and 2B, FIG. 2A shows a partial, perspective, exploded view of an LED lamp structure with high-efficiency heat-dissipating function according to the second embodiment of the present invention, FIG. 2B shows a lateral, cross-sectional view of an LED lamp structure having a top board body, a bottom board body, and a joint board body according to the second embodiment of the present invention. The second embodiment of the present invention provides an LED lamp structure B with high-efficiency heat-dissipating function, including a heat-dissipating module 1*b*, a light-emitting module 2, a power-transmitting module 3, and a heat-dissipating substrate 5*b*.

The heat-dissipating module 1*b* has a plurality of heat-dissipating fins 10*b*. The heat-dissipating fins 10*b* are combined together to form a radial shape and a receiving space 11*b* formed at a central position of the heat-dissipating module 1*b*. Hence, the heat-dissipating module 1*b* is a heat-dissipating module with radial fins.

Moreover, each heat-dissipating fin 10*b* has a stacked portion 100*b* and a fined portion 101*b* extended forward and upward from a lateral side of the stacked portion 100*b*. The heat-dissipating module 1*b* has a plurality of through holes 102*b* formed between each two fined portions 101*b*. The two leading wires 30 of the power-transmitting module 3 pass through any two of the through holes 102*b*. In the second embodiment, the stacked portions 100*b* are left and right stacked with each other to make the heat-dissipating fins 10*b* stacked with each other and combined together.

Hence the difference between the second embodiment and the first embodiment is that the LED lamp structure B of the second embodiment uses the heat-dissipating substrate 5*b* that is received in the receiving space 11*b*, and is disposed on top surfaces 1000*b* of the stacked portions 100*b* and among the heat-dissipating fins 10*b*. In addition, the heat-dissipating substrate 5*b* has a peripheral face abutting against inner lateral sides 1010*b* of the fined portions 101*b*. The light-emitting module 2 is disposed on the heat-dissipating substrate 5*b*. According to different heat-dissipating needs, the heat-dissipating substrate can be designed as a hollow or solid heat-dissipating substrate. According to different design spaces, the shape of the heat-dissipating substrate 5*b* can be cylindrical shape or any shape such as rectangle or polygon.

Figure 3A:
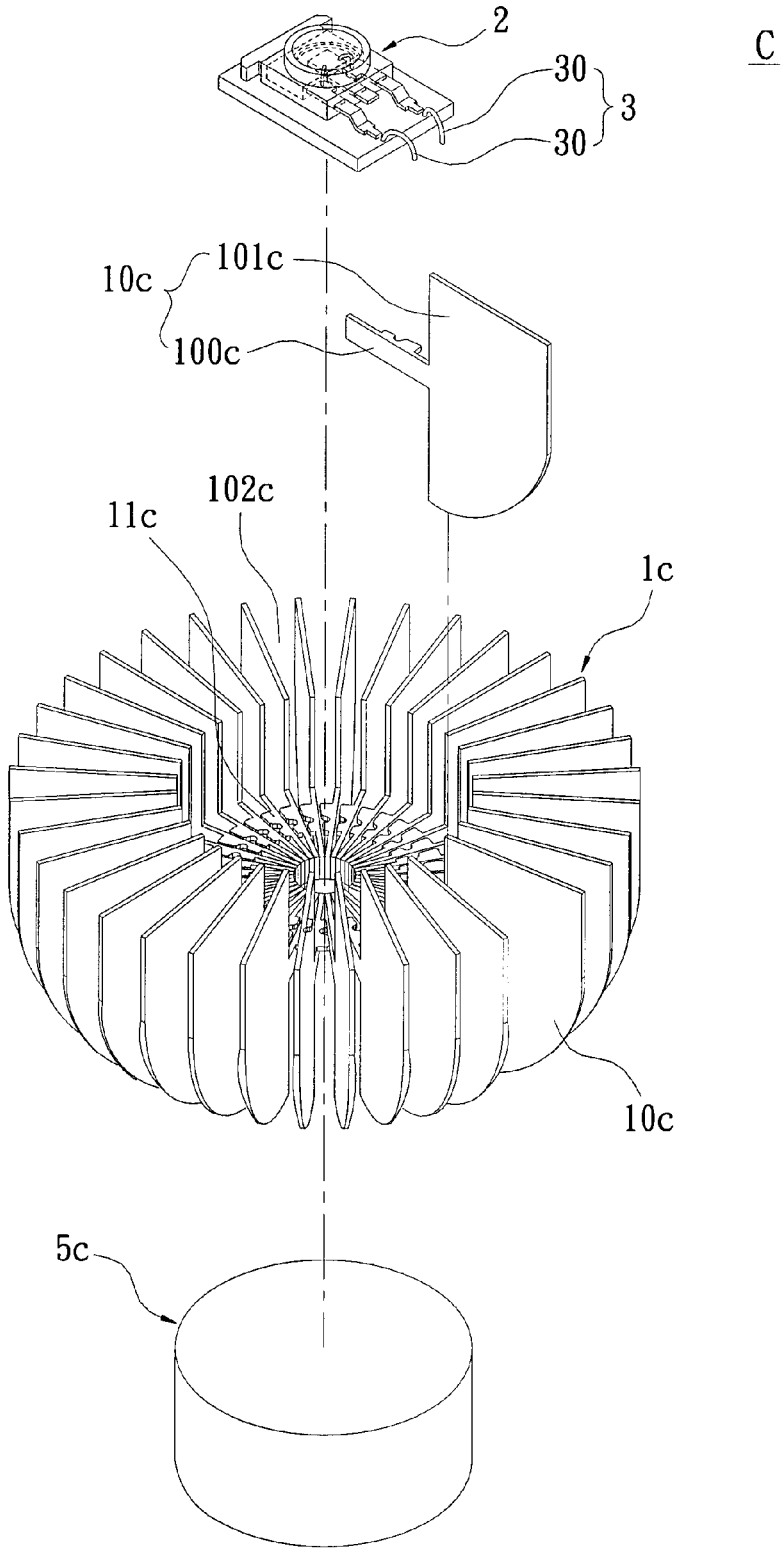
FIG. 3A is a partial, perspective, exploded view of an LED lamp structure with high-efficiency heat-dissipating function according to the third embodiment of the present invention.
Figure 3B:
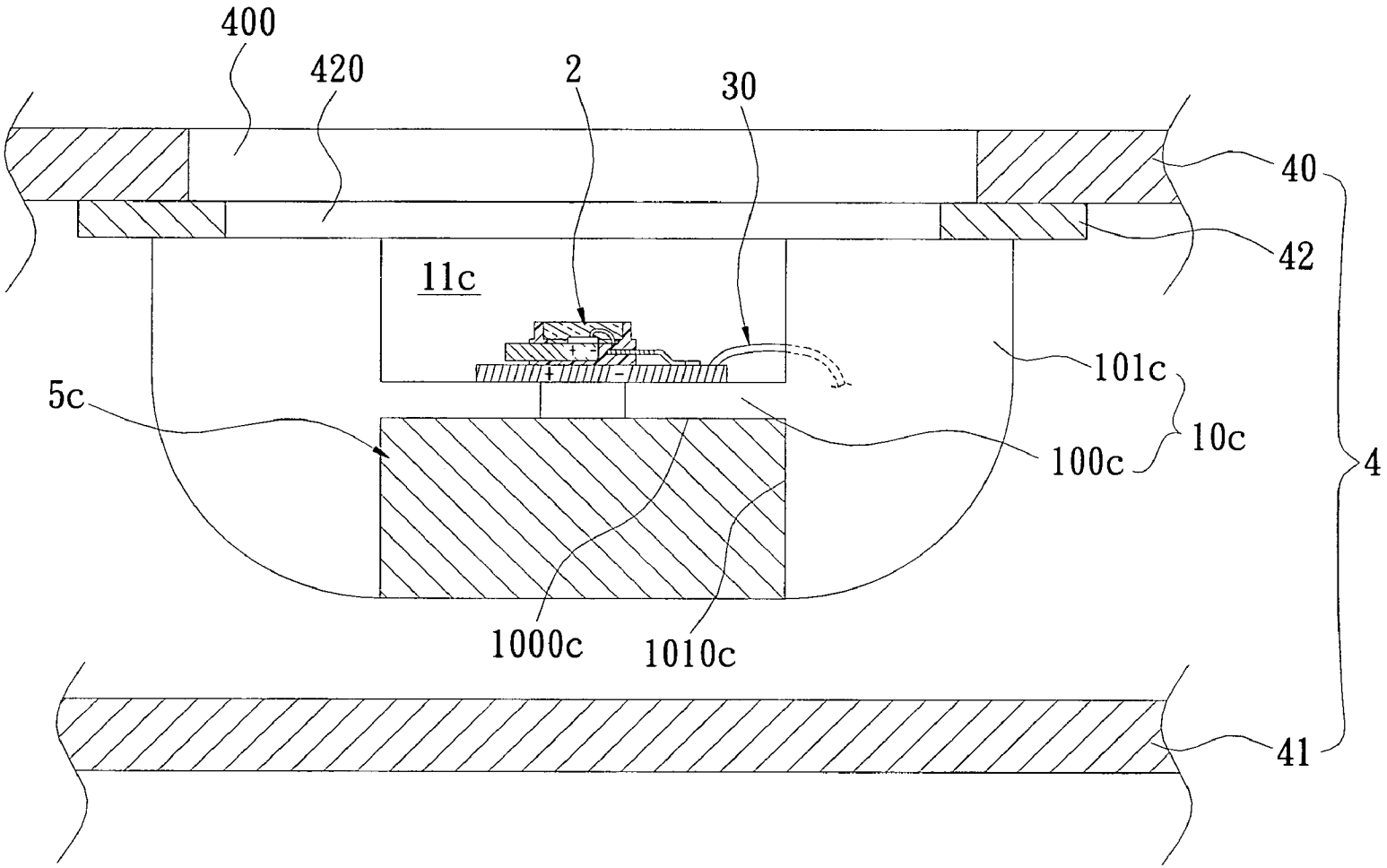
FIG. 3B is a lateral, cross-sectional view of an LED lamp structure having a top board body, a bottom board body, and a joint board body according to the third embodiment of the present invention.

Referring to FIGS. 3A and 3B, FIG. 3A shows a partial, perspective, exploded view of an LED lamp structure with high-efficiency heat-dissipating function according to the third embodiment of the present invention, FIG. 3B shows a lateral, cross-sectional view of an LED lamp structure having a top board body, a bottom board body, and a joint board body according to the third embodiment of the present invention. The third embodiment of the present invention provides an LED lamp structure C with high-efficiency heat-dissipating function, including a heat-dissipating module 1*c*, a light-emitting module 2, a power-transmitting module 3, and a heat-dissipating substrate 5*c*.

The heat-dissipating module 1*c* has a plurality of heat-dissipating fins 10*c*. The heat-dissipating fins 10*c* are combined together to form a radial shape and a receiving space 11*c* formed at a central position of the heat-dissipating module 1*c*. Hence, the heat-dissipating module 1*c* is a heat-dissipating module with radial fins.

Moreover, each heat-dissipating fin 10*c* has a stacked portion 100*c* and a fined portion 101*c* extended forward, upward and downward from a lateral side of the stacked portion 100*c*. The heat-dissipating module 1*c* has a plurality of through holes 102*c* formed between each two fined portions 101*c*. The two leading wires 30 of the power-transmitting module 3 pass through any two of the through holes 102*c*. In the third embodiment, the stacked portions 100*c* are left and right stacked with each other to make the heat-dissipating fins 10*c* stacked with each other and combined together.

Hence the difference between the third embodiment and the second embodiment is that a top side of the heat-dissipating substrate 5*c* of the third embodiment abuts against bottom surfaces 1000*c* of the stacked portions 100*c* and inner lateral sides 1010*c* of the fined portions 101*c*. In addition, the heat-dissipating substrate 5*c* has a peripheral face abutting against inner lateral sides 1010*c* of the fined portions 101*c*. The light-emitting module 2 is disposed on the stacked portions 100*c*.

Figure 4A:
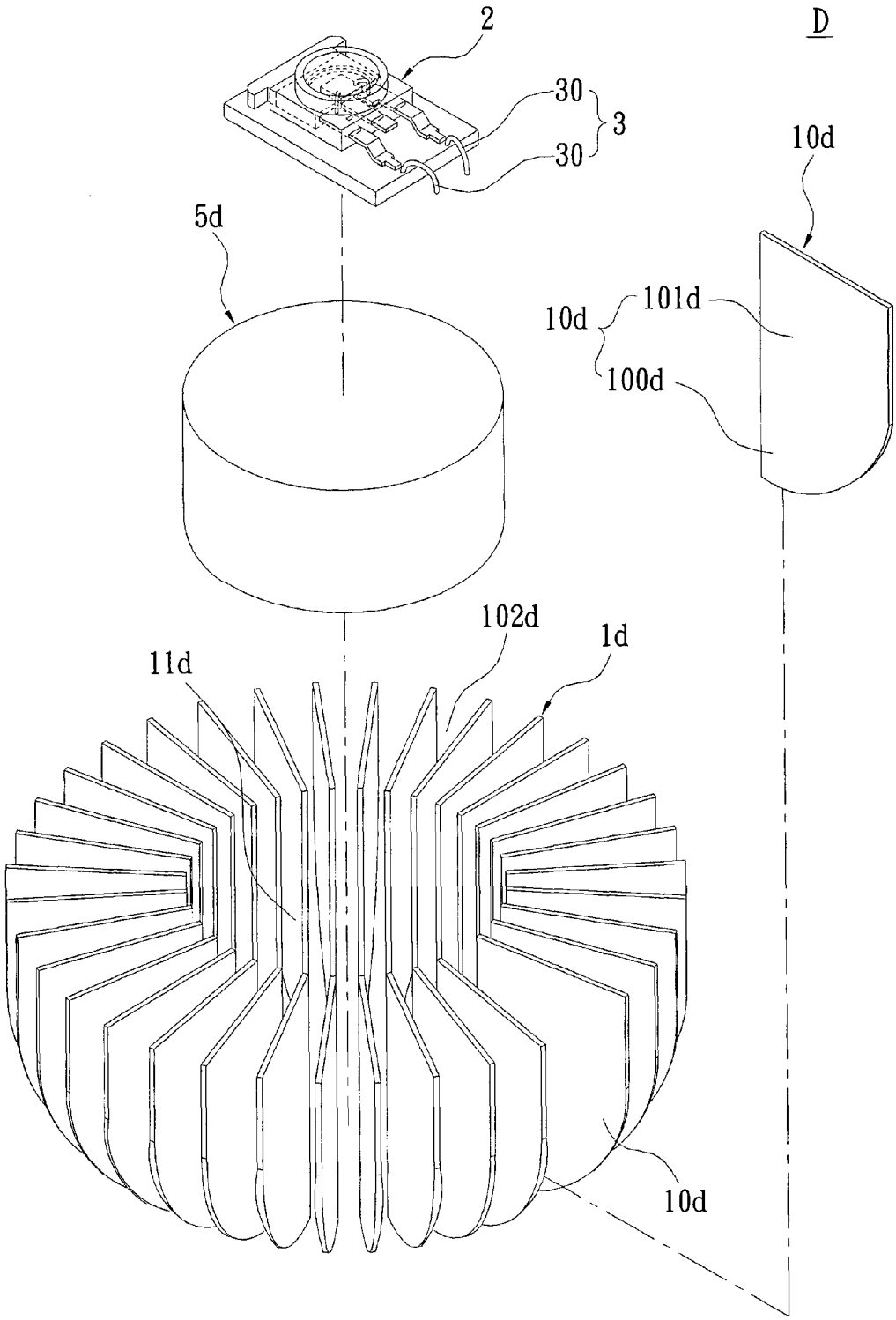
FIG. 4A is a partial, perspective, exploded view of an LED lamp structure with high-efficiency heat-dissipating function according to the fourth embodiment of the present invention.
Figure 4B:
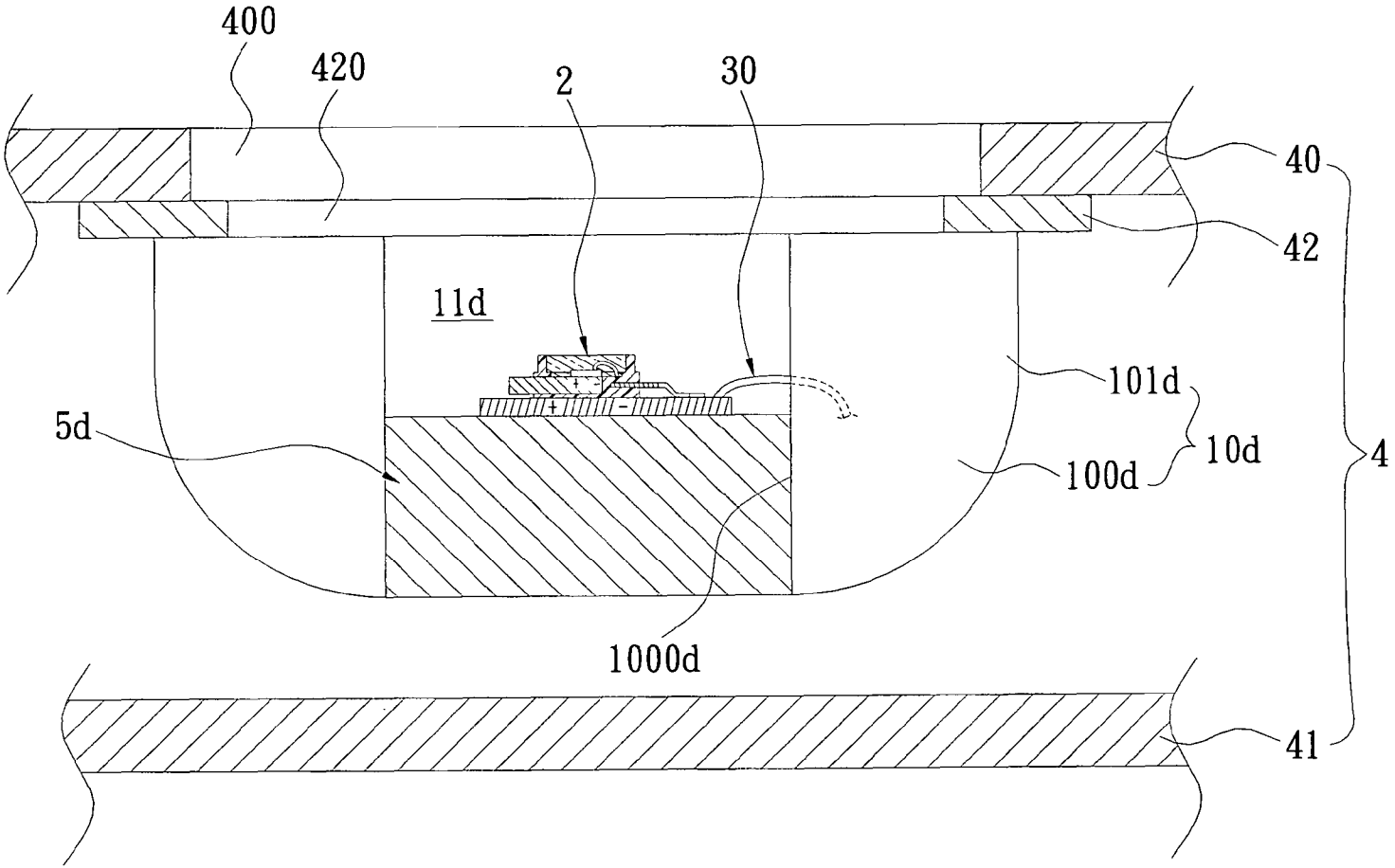
FIG. 4B is a lateral, cross-sectional view of an LED lamp structure having a top board body, a bottom board body, and a joint board body according to the fourth embodiment of the present invention.

Referring to FIGS. 4A and 4B, FIG. 4A shows a partial, perspective, exploded view of an LED lamp structure with high-efficiency heat-dissipating function according to the fourth embodiment of the present invention, FIG. 4B shows a lateral, cross-sectional view of an LED lamp structure having a top board body, a bottom board body, and a joint board body according to the fourth embodiment of the present invention. The fourth embodiment of the present invention provides an LED lamp structure D with high-efficiency heat-dissipating function, including a heat-dissipating module 1*d*, a light-emitting module 2, a power-transmitting module 3, and a heat-dissipating substrate 5*d*.

The heat-dissipating module 1*d* has a plurality of heat-dissipating fins 10*d*. The heat-dissipating fins 10*d* are combined together to form a radial shape and a receiving space 11*d* formed at a central position of the heat-dissipating module 1*d*. Hence, the heat-dissipating module 1*d* is a heat-dissipating module with radial fins.

Moreover, each heat-dissipating fin 10*d* has a fixed portion 100*d* and a fined portion 101*d* extended upward from the fixed portion 100*d*. The heat-dissipating module 1*d* has a plurality of through holes 102*d* formed between each two fixed portions 100*d*. The two leading wires 30 of the power-transmitting module 3 pass through any two of the through holes 100*d*.

Hence the difference between the fourth embodiment and other embodiments (the first, second, and third embodiments) is that the heat-dissipating substrate 5*d* has a peripheral face abutting against inner lateral sides 1000*d* of the fixed portions 100*d*. The light-emitting module 2 is disposed on the stacked portions 100*c*. In addition, the light-emitting module 2 is disposed on the heat-dissipating substrate 5*d*.

Figure 5A:
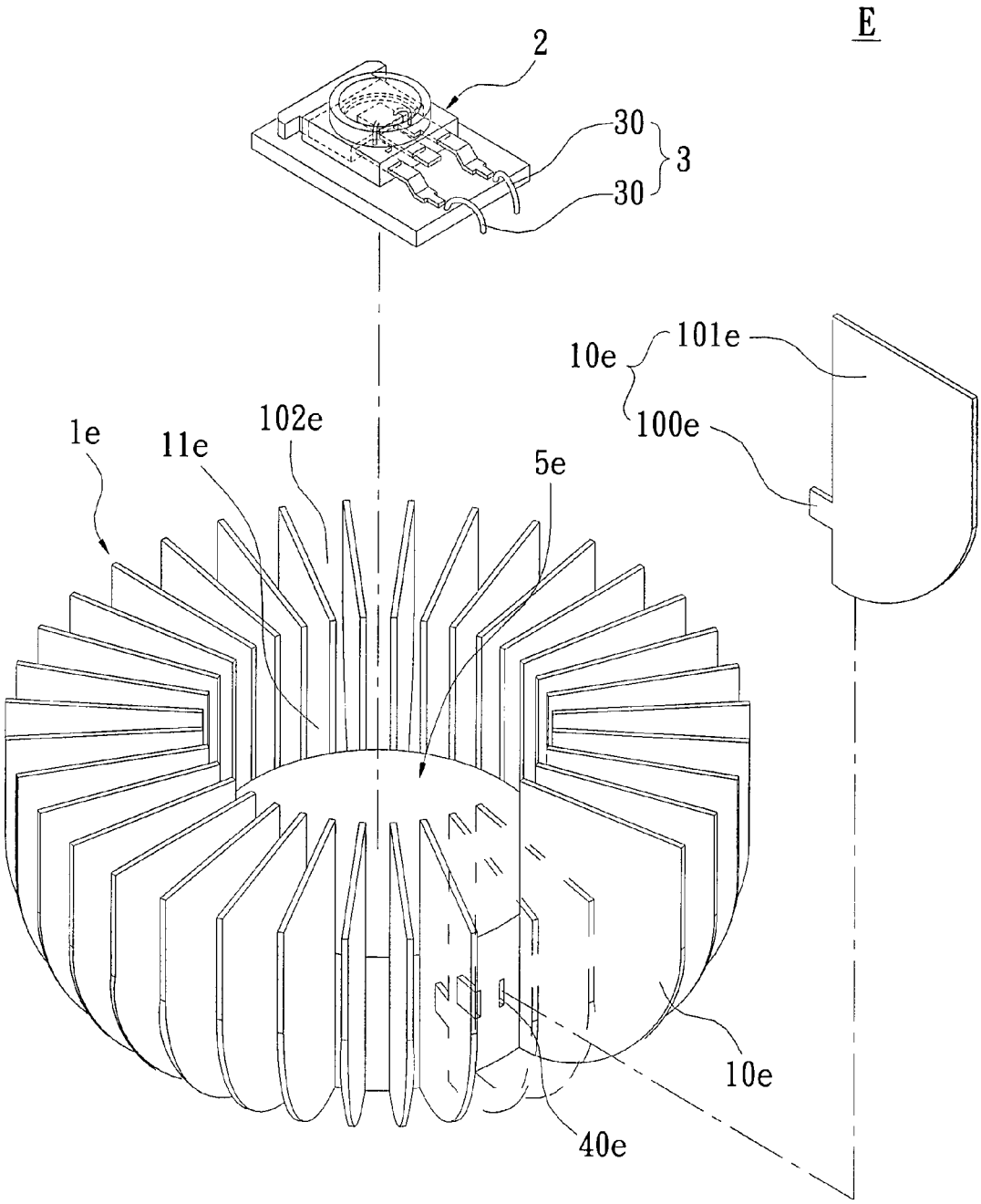
FIG. 5A is a partial, perspective, exploded view of an LED lamp structure with high-efficiency heat-dissipating function according to the fifth embodiment of the present invention.
Figure 5B:
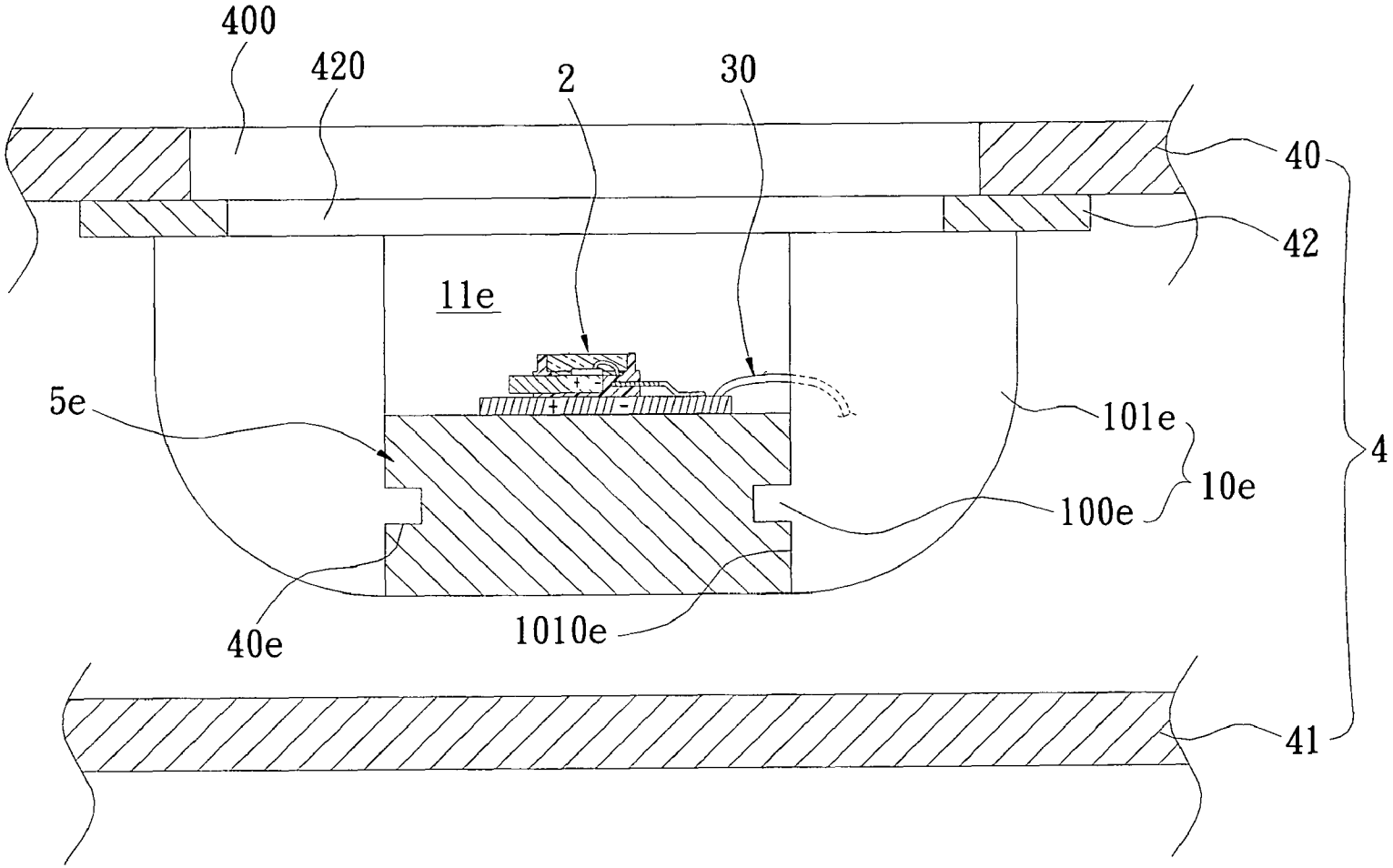
FIG. 5B is a lateral, cross-sectional view of an LED lamp structure having a top board body, a bottom board body, and a joint board body according to the fifth embodiment of the present invention.

Referring to FIGS. 5A and 5B, FIG. 5A shows a partial, perspective, exploded view of an LED lamp structure with high-efficiency heat-dissipating function according to the fifth embodiment of the present invention, FIG. 5B shows a lateral, cross-sectional view of an LED lamp structure having a top board body, a bottom board body, and a joint board body according to the fifth embodiment of the present invention. The fifth embodiment of the present invention provides an LED lamp structure E with high-efficiency heat-dissipating function, including a heat-dissipating module 1*e*, a light-emitting module 2, a power-transmitting module 3, and a heat-dissipating substrate 5*e*.

The heat-dissipating module 1*e* has a plurality of heat-dissipating fins 10*e*. The heat-dissipating fins 10*e* are combined together to form a radial shape and a receiving space 11*e* formed at a central position of the heat-dissipating module 1*e*. Hence, the heat-dissipating module 1*e* is a heat-dissipating module with radial fins.

Moreover, each heat-dissipating fin 10*e* has an embedded portion 100*e* and a fined portion 101*e* extended forward, upward and downward from a lateral side of the embedded portion 100*e*. The heat-dissipating module 1*e* has a plurality of through holes 102*e* formed between each two fined portions 101*e*. The two leading wires 30 of the power-transmitting module 3 pass through any two of the through holes 102*e*.

Hence the difference between the fifth embodiment and other embodiments is that the heat-dissipating substrate 5*e* has a plurality of concave grooves 40*e* formed on a peripheral face thereof and corresponding to the embedded portions 100*e*. Each embedded portion 100*e* of each heat-dissipating fin 10*e* is embedded into the concave groove 40*e* in order to make the peripheral face of the heat-dissipating substrate 5*e* abut against inner lateral sides 1010*e* of the fined portions 101*e*. In addition, the light-emitting module 2 is disposed on the heat-dissipating substrate 5*e*.

Figure 6:
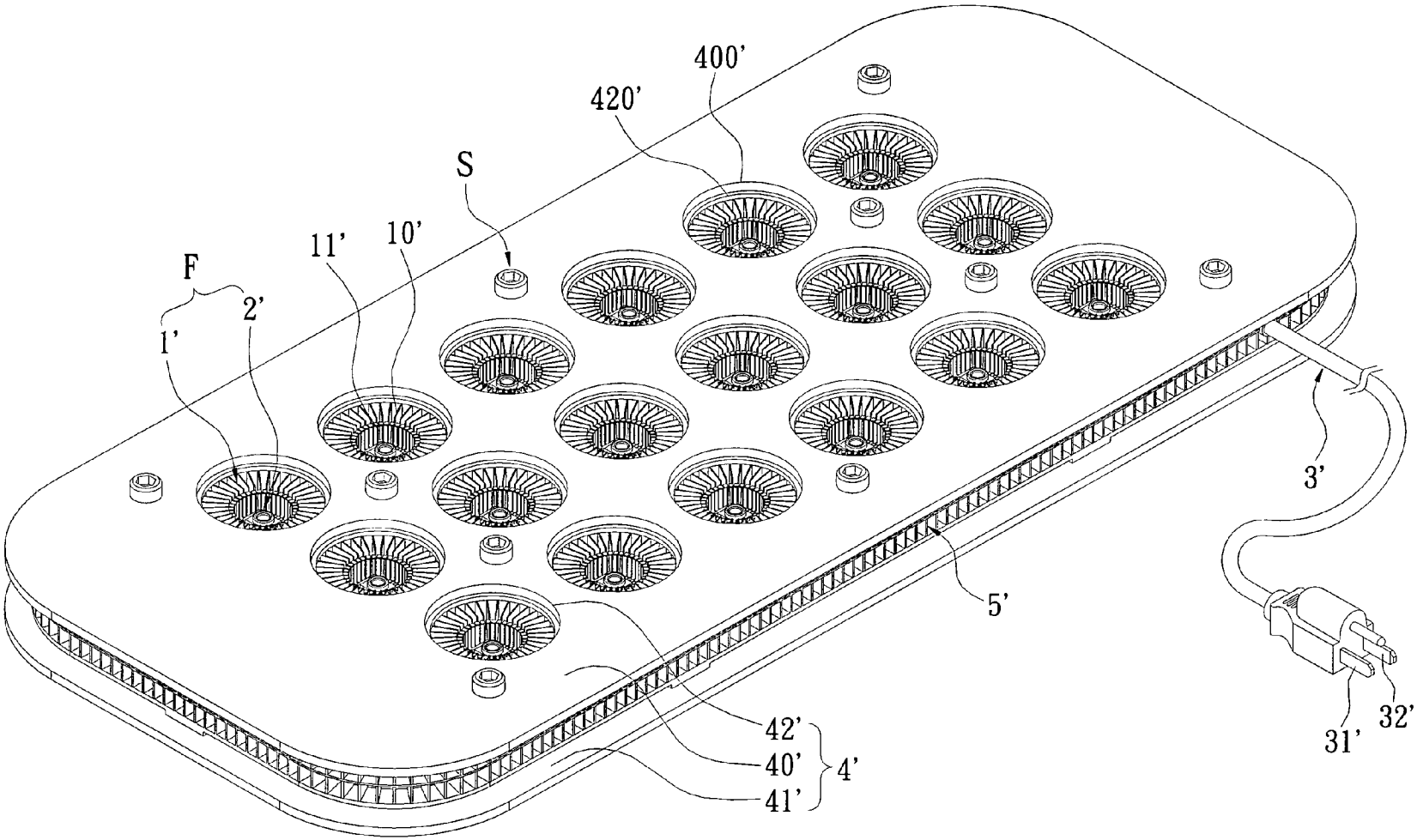
FIG. 6 is perspective view of an LED lamp system of the present invention.

FIG. 6 shows perspective view of an LED lamp system of the present invention. The present invention provides an LED lamp system with high-efficiency heat-dissipating function, including a plurality of LED lamp structures F, a power supply plug 3', and a casing module 4'. Each LED lamp structure F includes a heat-dissipating module 1', a light-emitting module 2', a power-transmitting module (not shown), and a heat-dissipating substrate 5*e*. In addition, the LED lamp structures F are arranged together to form a streetlamp structure.

The heat-dissipating module 1' has a plurality of heat-dissipating fins 10'. The heat-dissipating fins 10' are combined together to form a radial shape and a receiving space 11' formed at a central position of the heat-dissipating module 1'. The light-emitting module 2' is received in the receiving space 11' of the heat-dissipating module 1'. The power-transmitting module is electrically connected with the light-emitting module 2'.

Moreover, the power supply plug 3' is electrically connected with the power-transmitting module of each LED lamp structure F. In other words, each power-transmitting module has a positive leading wire and a negative leading wire (not shown) electrically connected with a positive side 31' and a negative side 32' of the power supply plug 3, respectively.

Furthermore, the casing module 4' has a top board body 40', a bottom board body 41' mated with the top board body 40', and a joint board body 42' disposed between the top board body 40' and the heat-dissipating fins 10'. Both the top board body 40' and the joint board body 42' have an opening (400', 420') for exposing the light-emitting modules 2'. In addition, the top board body 40' and the bottom board body 41' are assembled and screwed together via many screws S. According to different usage needs, the LED lamp system further includes a plurality of fins 5' disposed between the top board body 40' and the bottom board body 41'. The fins 5' are combined together to surround the LED lamp structures F.

However, the LED lamp structures F arranged and assembled as a streetlamp structure is not used to limit the present invention. The LED lamp structures F can be arranged and assembled as any shape. For example, the LED lamp structures F is arranged and assembled straightly as a desk lamp.

Moreover, the LED lamp structures (A, B, C, D, E) of the above-mentioned embodiments can be applied to the LED lamp system of the present invention. In other words, according to user's needs, the LED lamp structure F can be replaced by any one type of the LED lamp structures (A, B, C, D, E).

In conclusion, the present invention use a heat-dissipating module with radial-shape fins for supplying high-efficiency heat-dissipating function to high power LED. Hence LEDs of the present invention are used in a low temperature to ensure that the usage life of the LEDs is increased. In other words, the LED lamp structure and system can provides high-efficiency heat-dissipating function for increasing the usage life of LEDs of the present invention, high power LED especially.

Although the present invention has been described with reference to the preferred best molds thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An LED lamp structure with high-efficiency heat-dissipating function, comprising:

a heat-dissipating module having a plurality of heat-dissipating fins, wherein the heat-dissipating fins are combined together to form a radial shape and a receiving space, wherein each heat-dissipating fin has an embedded portion and a finned portion extended forward, upward and downward from a lateral side of the embedded portion;

a light-emitting module received in the receiving space of the heat-dissipating module;

a power-transmitting module electrically connected with the light-emitting module; and a heat-dissipating substrate, the heat-dissipating substrate having a plurality of concave grooves formed on a peripheral face thereof in corresponding relationship with the embedded portions of said heat-dissipating fins, wherein each embedded portion of each heat-dissipating fin is embedded into a respective one of said plurality of concave grooves, and wherein the peripheral face of the heat-dissipating substrate abuts against inner lateral sides of the finned portions.

2. The LED lamp structure as claimed in claim 1, wherein the heat-dissipating fins are stacked with each other.

3. The LED lamp structure as claimed in claim 1, wherein the light-emitting module is disposed on the heat-dissipating substrate.

4. The LED lamp structure as claimed in claim 1, wherein the power-transmitting module has two leading wires, and each leading wire passes through a gap between any two finned portions.

5. The LED lamp structure as claimed in claim 1, wherein the light-emitting module includes a substrate with a positive conductive track and a negative conductive track, two inner conductive pins, at least one light-emitting element electrically connected with the positive conductive track and the negative conductive track via the two inner conductive pins, a fluorescent colloid covered on the at least one light-emitting element, and a light-shielding frame body for covering a peripheral face of the fluorescent colloid and only exposing a top surface of the fluorescent colloid.

6. The LED lamp structure as claimed in claim 5, wherein the power-transmitting module has two leading wires electrically connected with the positive conductive track and the negative conductive track of the substrate, respectively.

7. The LED lamp structure as claimed in claim 1, further comprising a casing module, wherein the casing module has a top board body, a bottom board body mated with the top board body, and a joint board body disposed between the top board body and the heat-dissipating fins, and both the top board body and the joint board body have an opening for exposing the light-emitting module.

8. The LED lamp structure as claimed in claim 7, wherein each heat-dissipating fin has a top side and a bottom side respectively contacted with the joint board body and the bottom board body.

9. The LED lamp structure as claimed in claim 7, wherein each heat-dissipating fin has a top side contacted with the joint board body and a bottom side separated from the bottom board body by a predetermined distance.

10. An LED lamp system with high-efficiency heat-dissipating function, comprising:

a plurality of LED lamp structures, wherein each LED lamp structure comprises:

a heat-dissipating module having a plurality of heat-dissipating fins, wherein the heat-dissipating fins are combined together to form a radial shape and a receiving space;

a light-emitting module received in the receiving space of the heat-dissipating module; and a power-transmitting module electrically connected with the light-emitting module;

a casing module, the casing module including a top board body, a bottom board body mated with the top board body, and a joint board body disposed between the top board body and the heat-dissipating fins, wherein each of the top board body and the joint board body has an opening formed therein for exposing the light-emitting modules; and a power supply plug electrically connected with the power-transmitting module of each LED lamp structure.

11. The LED lamp system as claimed in claim 10, wherein each power-transmitting module has a positive leading wire and a negative leading wire electrically connected with a positive side and a negative side of the power supply plug, respectively.

12. The LED lamp system as claimed in claim 10, further comprising a plurality of fins disposed between the top board body and the bottom board body, wherein the fins are combined together to surround the LED lamp structures.

13. The LED lamp system as claimed in claim 10, wherein each heat-dissipating fin of each heat-dissipating module has a stacked portion and a finned portion extended forward, upward and downward from a lateral side of the stacked portion.

14. The LED lamp system as claimed in claim 13, wherein each LED lamp structure further comprises a heat-dissipating substrate abutting against bottom surfaces of the corresponding stacked portions and inner lateral sides of the corresponding finned portions.

15. The LED lamp system as claimed in claim 13, wherein each light-emitting module is disposed on the stacked portions of each corresponding heat-dissipating module.

16. The LED lamp system as claimed in claim 10, wherein each heat-dissipating fin of each heat-dissipating module has an embedded portion and a finned portion extended forward, upward and downward from a lateral side of the embedded portion.

17. The LED lamp system as claimed in claim 16, wherein each LED lamp structure further comprises a heat-dissipating substrate, wherein the heat-dissipating substrate has a plurality of concave grooves formed on a peripheral face thereof and corresponding to the embedded portions, and each embedded portion of each heat-dissipating fin is embedded into the concave groove in order to make the peripheral face of the heat-dissipating substrate abut against inner lateral sides of the finned portions.

18. The LED lamp system as claimed in claim 17, wherein the light-emitting modules are disposed on the corresponding heat-dissipating substrates, respectively.

19. The LED lamp system as claimed in claim 10, wherein each heat-dissipating fin of each heat-dissipating module has a fixed portion and a finned portion extended upward from the fixed portion.

20. The LED lamp system as claimed in claim 19, wherein each LED lamp structure further comprises a heat-dissipating substrate abutting against inner lateral sides of the fixed portions of each corresponding heat-dissipating module.

21. The LED lamp system as claimed in claim 20, wherein the light-emitting modules are respectively disposed on the corresponding heat-dissipating substrates.

22. The LED lamp system as claimed in claim 20, wherein the fixed portions of each heat-dissipating fin of each heat-dissipating module are surroundingly fixed on a peripheral face of each corresponding heat-dissipating substrate.

23. The LED lamp system as claimed in claim 10, wherein each heat-dissipating fin of each heat-dissipating module has a stacked portion and a finned portion extended forward and upward from a lateral side of the stacked portion.

24. The LED lamp system as claimed in claim 23, wherein each light-emitting module is correspondingly disposed on the stacked portions of the heat-dissipating fins of each heat-dissipating module.

25. The LED lamp system as claimed in claim 23, wherein each LED lamp structure further comprises a heat-dissipating substrate received in the corresponding receiving space and disposed on top surfaces of the corresponding stacked portions, and the heat-dissipating substrate has a peripheral face abutting against inner lateral sides of the corresponding finned portions.

26. The LED lamp system as claimed in claim 25, wherein the light-emitting modules are respectively disposed on the corresponding heat-dissipating substrates.

* * * * *